US008083396B2

(12) United States Patent
Wang

(10) Patent No.: US 8,083,396 B2
(45) Date of Patent: Dec. 27, 2011

(54) MIXING MACHINE FOR AGITATING AND MINGLING MATERIALS

(75) Inventor: Cheng-Chung Wang, Taipei (TW)

(73) Assignee: Chien-Cheng Wang, Taipei (TW)

( * ) Notice: Subject to any disclaimer, the term of this patent is extended or adjusted under 35 U.S.C. 154(b) by 313 days.

(21) Appl. No.: 12/466,806

(22) Filed: May 15, 2009

(65) Prior Publication Data

US 2009/0285050 A1 Nov. 19, 2009

(30) Foreign Application Priority Data

May 16, 2008 (TW) ..... 97208588 U

(51) Int. Cl.
*B01F 9/02* (2006.01)

(52) U.S. Cl. ..... 366/217; 475/11

(58) Field of Classification Search ..... 366/217; 475/11

See application file for complete search history.

(56) References Cited

U.S. PATENT DOCUMENTS 3,199,775 A * 8/1965 Drucker ..... 494/19
7,487,958 B2 * 2/2009 Wang ..... 267/136
2006/0254869 A1 * 11/2006 Wang ..... 188/378

* cited by examiner

*Primary Examiner* — David Sorkin
(74) *Attorney, Agent, or Firm* — Muncy, Geissler, Olds & Lowe, PLLC

(57) ABSTRACT

A mixing machine for agitating and mingling materials is disclosed. The mixing machine comprises a base and a driving device disposed on the base, and the driving device is connected to a rotary bracket and has a fixing portion with a container for receiving a mixture of materials mounted thereon, such that the mixture of materials may be agitated and mingled while the driving device drives the rotary bracket. A transmission device is disposed between the driving device and the rotary bracket, and the transmission device comprises a first spur gear, a second spur gear, and a bevel gear intermeshed which are successively intermeshed, wherein the first spur gear and the second spur gear are meshed together and fitted to parallel axles, the second spur gear and the bevel gear are meshed together, and the bevel gear connects to the fixing portion.

6 Claims, 5 Drawing Sheets

MIXING MACHINE FOR AGITATING AND MINGLING MATERIALS

FIELD OF THE INVENTION

The present invention relates to a mixing machine for agitating and mingling materials, particularly, to a mixing machine utilizing two spur gears and a bevel gear to obtain advantages of simple structure, high reliability, long life span and easy maintenance for agitating and mingling molding powders or Gypsum powders.

BACKGROUND

In a molding process, a given amount of molding powder is added into a container, and liquid is added to the molding powder to blend and mingle the molding powder with liquid evenly by a mixing machine. However, the design of transmission system of a conventional mixing machine utilizes two bevel gears (miter gears) inter-connected with a spur gear; with two bevel gears in mesh, the vertices of their two cones lie on a single point, such that only point contact will be achieved between tooth surfaces, not line contact across the full width of the tooth. The transmit forces under such a construction and arrangement may be exerted unequal across the tooth where the bevel gears meet at high speeds, and cause unbearable impact stress to make the bevels gears easily broken. Otherwise, the design of bevel gears in mesh makes the installation and removal of gears difficult, and causes the regular maintenance inconvenient and time consuming.

In order to overcome the foregoing shortcomings and problems, after hard research and development, a mixing machine for agitating and mingling materials that substantially departs from the conventional concepts and designs of the prior art is provided by the present invention, in so doing provides an apparatus primarily developed for the purpose of providing a mixing machine for agitating and mingling materials with sufficient structure strength and low maintenance cost.

SUMMARY OF THE INVENTION

The primary object of the present invention is to provide a mixing machine for agitating and mingling materials having simple structure, long life span, and easy maintenance.

In order to achieve the aforementioned object, the mixing machine for agitating and mingling materials according to the present invention comprises a base and a driving device disposed on the base. The driving device is connected to a rotary bracket and has a fixing portion with a container for receiving a mixture of materials mounted thereon, such that the mixture of materials may be agitated and mingled while the driving device drives the rotary bracket. A transmission device is disposed between the driving device and the rotary bracket, and the transmission device comprises a first spur gear, a second spur gear, and a bevel gear intermeshed which are successively intermeshed, wherein the first spur gear and the second spur gear are meshed together and fitted to parallel axles, the second spur gear and the bevel gear are meshed together, and the bevel gear connects to the fixing portion.

Other objects, advantages and novel features of the present invention will become more apparent from the following detailed description when taken in conjunction with the accompanying drawings.

DETAILED DESCRIPTION

Figure 1:
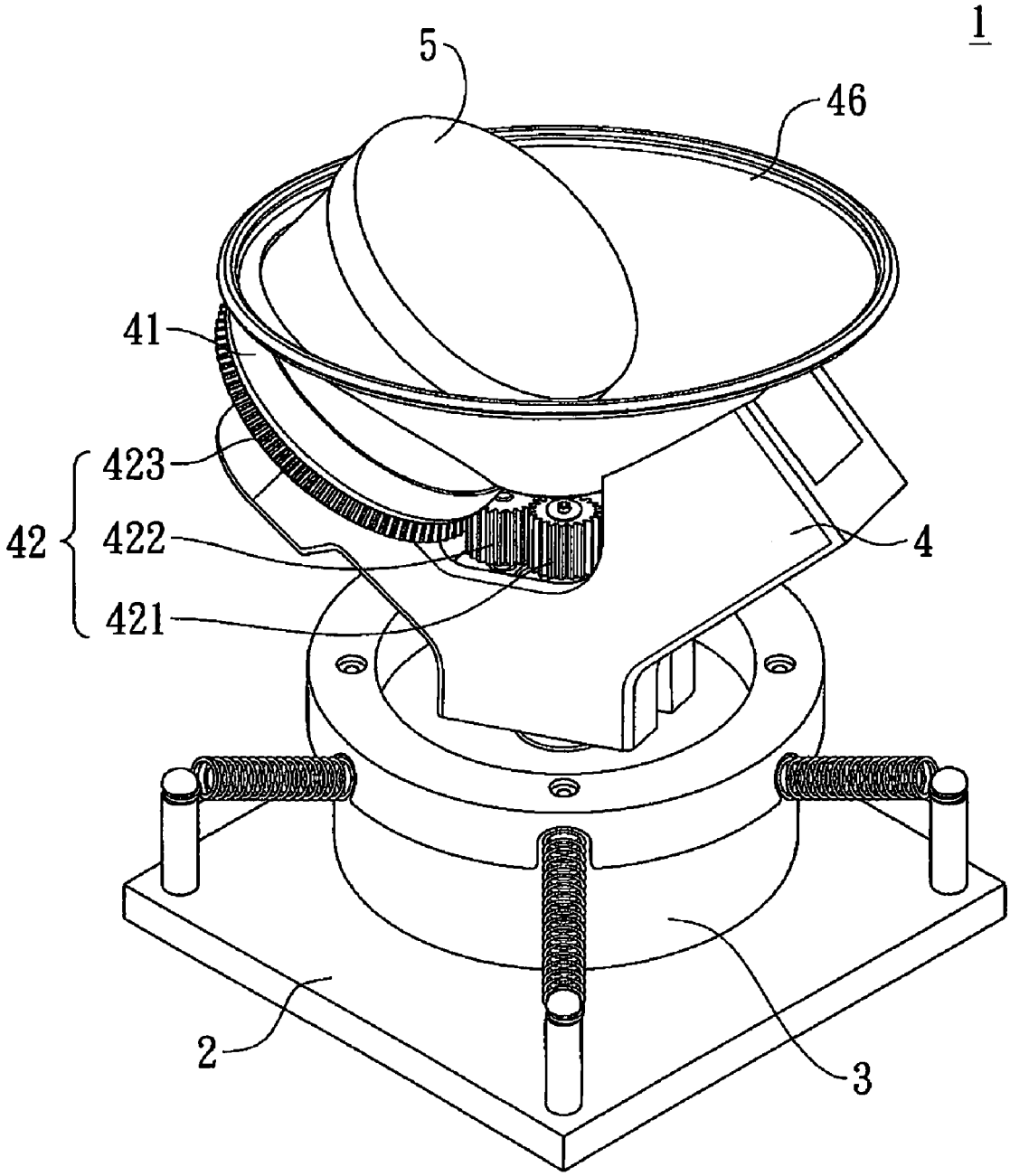
FIG. 1 is a perspective view of the mixing machine according to the present invention.
Figure 2:
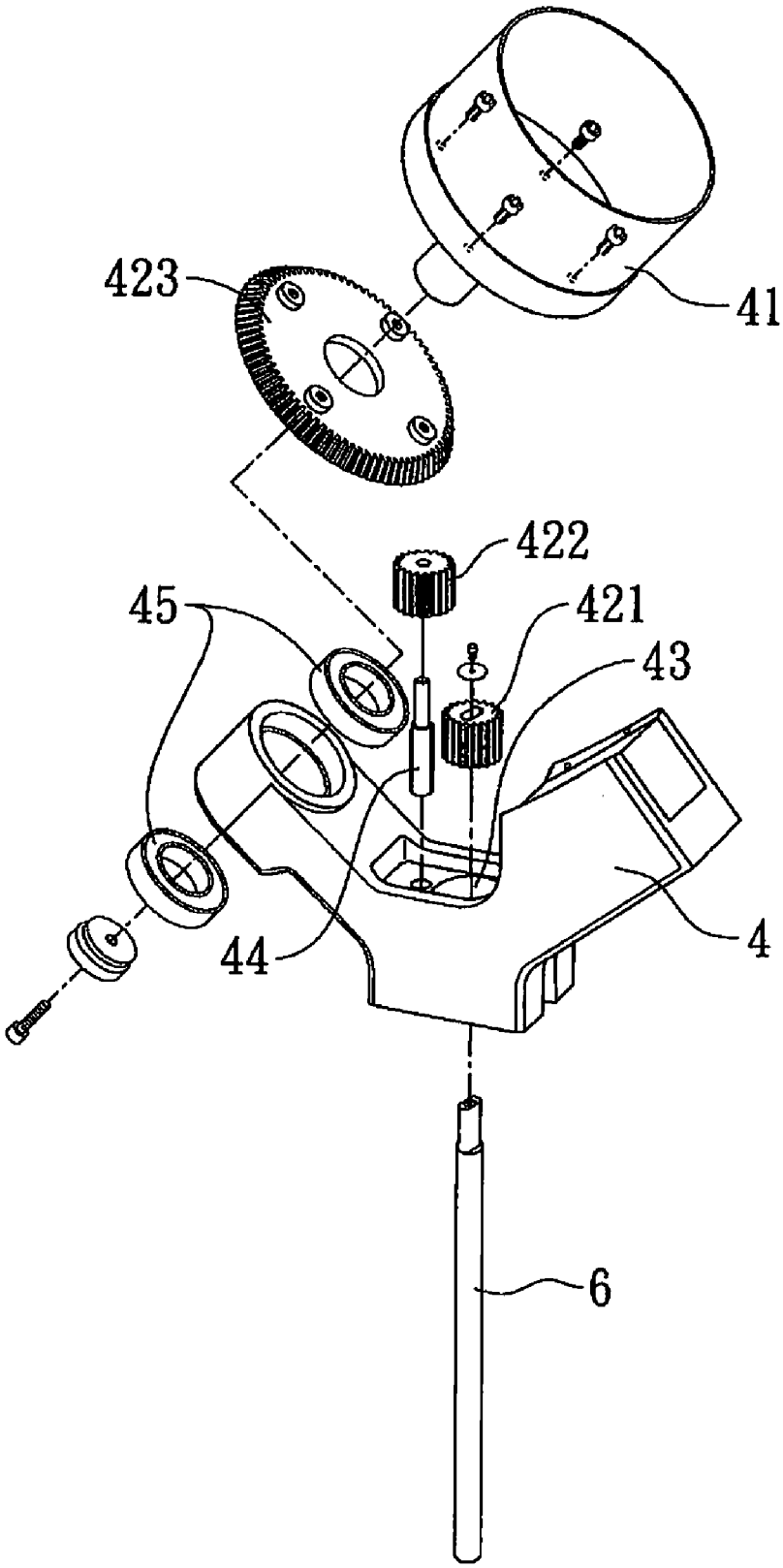
FIG. 2 presents a drawing showing the rotary bracket, the transmission device, and the fixing portion according to the present invention.

Referring to FIG. 1-5, a mixing machine 1 for agitating and mingling material of a preferred embodiment of the present invention is illustrated, wherein the mixing machine 1 is disposed with a base 2 having a driving device 3 disposed thereon. The driving device 3 is a motor and connects to a rotary bracket 4, and a fixing portion 41 is disposed on the rotary bracket 4 for a container 5 receiving a mixture of materials to mount thereon.

A transmission device 42 is disposed on the rotary bracket 4, and the transmission device 42 comprises a first spur gear 421, a second spur gear 422 and a bevel gear 423, wherein the general form of the first spur gear 421 and the second spur gear 422 is a cylinder, and the two spur gears are meshed together and fitted to parallel axles. The second spur gear 422 and the bevel gear 423 are meshed together, and the bevel gear 423 connects to the fixing portion 41.

The rotary bracket 4 includes a shaft hole 43 through which a fixing shaft 6 connected to the driving device 3 can be inserted, and the first spur gear 421 is removably mounted to the upper part of the fixing shaft 6. Further, the rotary bracket 4 includes a gear shaft 44 for securing the second spur gear 422 and a bearing 45 for fastening the fixing portion 41, and a containing bowl 46 is disposed between the rotary bracket 4 and the fixing portion 41.

Figure 3:
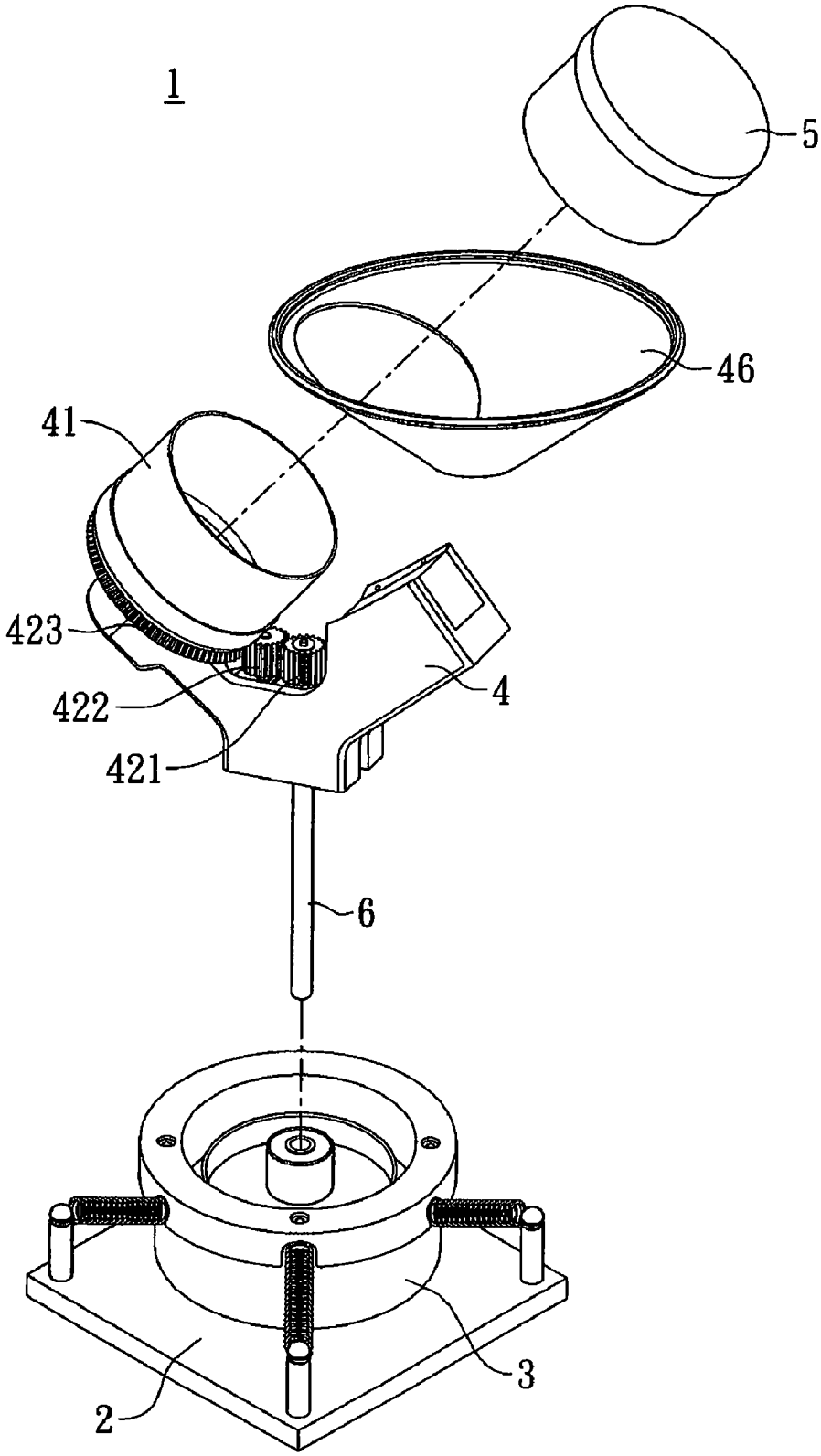
FIG. 3 is a perspective view showing the rotary bracket being connected to the base according to the present invention.
Figure 4:
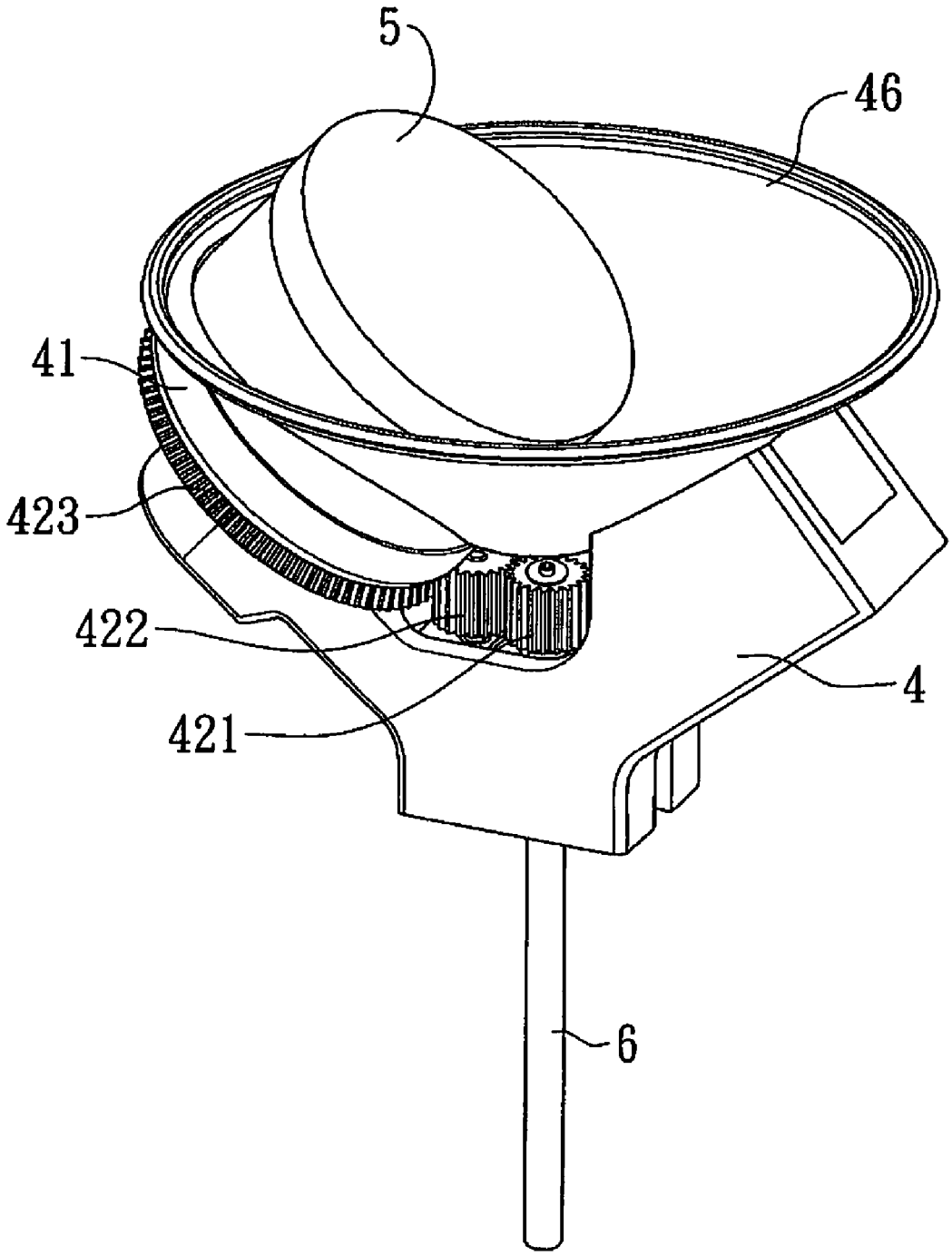
FIG. 4 is a perspective view showing the inter-connected rotary bracket, transmission device, and fixing portion according to the present invention.
Figure 5:
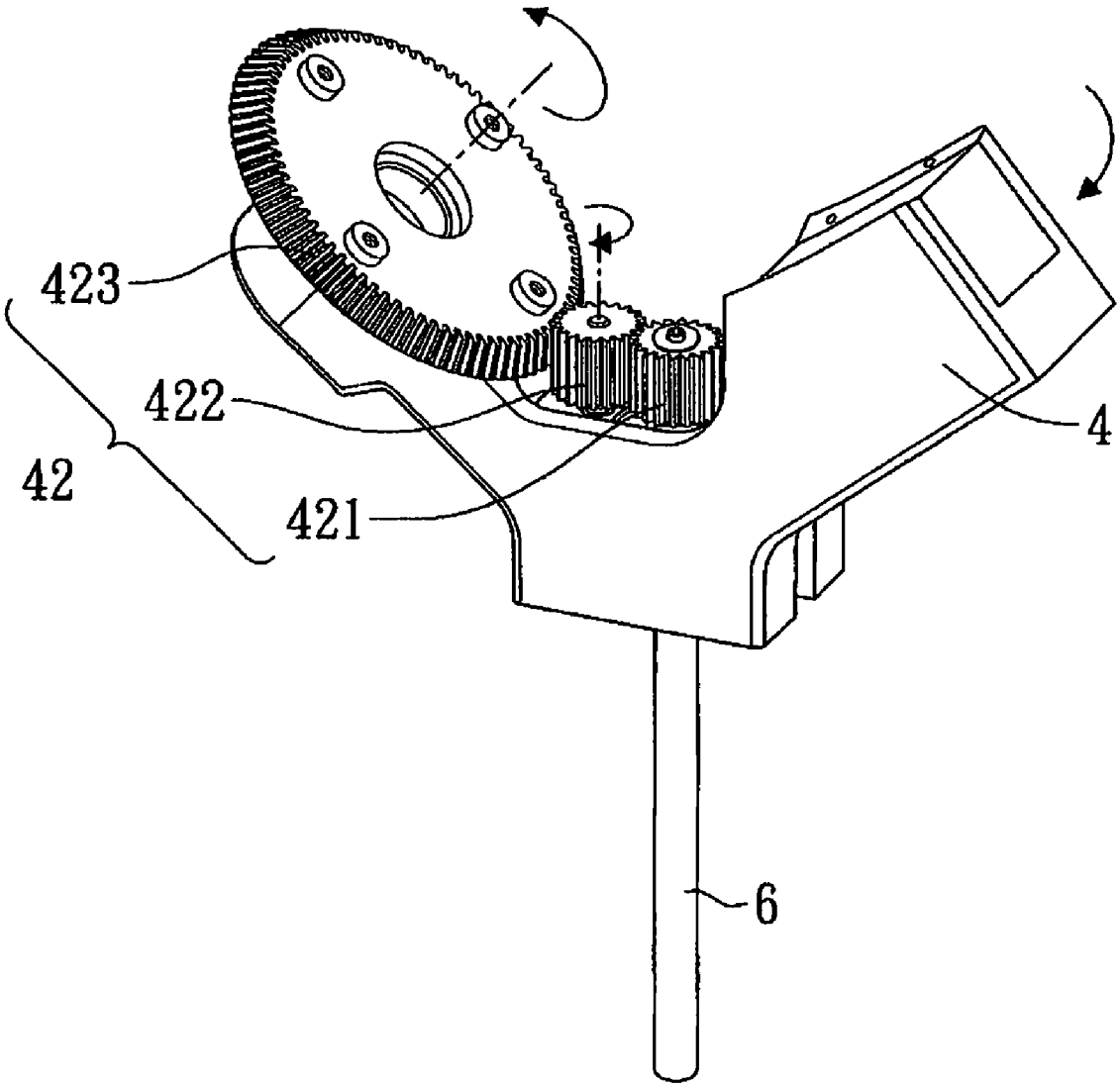
FIG. 5 is a perspective view showing the rotation operation of each gears on the rotary bracket according to the present invention.

In practice, as shown in FIGS. 3-5, when a container 5 received with a mixture of materials, such as molding powder or other powders, is mounted on the fixing portion 41, the rotary bracket 4 can be rotated by turning on the power of the driving device 3. As the rotary bracket 4 rotates clockwise and simultaneously rotates the second spur gear 422 of the rotary bracket 4, and the second spur gear 422 is disposed between the first spur gear 421 and the bevel gear 423 and meshed with each gear separately, the second spur gear 422 rolls on the first spur gear 421 while the first spur gear 421 is mounted on the fixing shaft 6 (as shown in FIG. 5), so that through the rotation of second spur gear 422 the bevel gear 423 are rotated anticlockwise, and therefore the fixing portion 41 connected to the bevel gear 423 is rotated in the same direction of the bevel gear 423 (anticlockwise) to enable the container 5 mounted on the fixing portion 41 to blend and mingle the materials inside the container 5.

Therefore, the present invention has the following advantages:

1. The present invention utilizes a transmission device 42 composed of a first spur gear 421, a second spur gear 422, and a bevel gear 423 to obtain a larger contacting tooth surface between the first spur gear 421 and the second spur gear 422 than that of conventional bevel gears, so that the exerted transmit forces across the tooth are equal to make the gears more durable for enduring high impact stress during operation, and increase the life span of the mixing machine.

2. The first spur gear 421 and second spur gear 422 are cylinders and fitted to parallel axles, and the bevel gear 423 is meshed with one of the spur gears, such that the contacting tooth surfaces are perpendicular to each other but not in oblique contact. Therefore, the first spur gear 421 removably mounted on the fixing shaft 6 can be directly replaced when needed, and this structure is different from the conventional mixing machine that other gears must be removed first.

3. The first spur gear of the present invention is removably mounted to the fixing shaft 6 to enable the first spur gear to be repaired and replaced immediately after it is broken, and there is no necessary to replace the fixing shaft 6; such a structure is different from the conventional mixing machine that the fixing shaft and the spur gear are integrated formed, and the whole fixing shaft needs to be replaced when the spur gear is broken. Therefore, the maintenance of the present invention is easy.

As stated in the above disclosed, the present invention can surely achieve its expected objects to provide a mixing machine for agitating and mingling materials with simple structure, high reliability, long life span, and easy maintenance.

It should be understood that different modifications and variations could be made from the disclosures of the present invention by the people familiar in the art without departing the spirit of the present invention.

What is claimed is:

1. A mixing machine for agitating and mingling materials, comprising:

a base;

a driving device disposed on the base and connected to a rotary bracket, the rotary bracket having a fixing portion with a container for receiving a mixture of materials mounted thereon, such that the mixture of materials may be agitated and mingled while the driving device drives the rotary bracket; and a transmission device disposed between the driving device and the rotary bracket, characterized in that:

the transmission device comprises a first spur gear, a second spur gear, and a bevel gear intermeshed which are successively intermeshed, wherein the first spur gear and the second spur gear are meshed together and fitted to parallel axles, the second spur gear and the bevel gear are meshed together, and the bevel gear connects to the fixing portion.

2. The mixing machine for agitating and mingling materials according to claim 1, wherein the rotary bracket includes a shaft hole through which a fixing shaft connected to the driving device can be inserted, and the first spur gear is removably mounted to the upper part of the fixing shaft.

3. The mixing machine for agitating and mingling materials according to claim 2, wherein the rotary bracket further includes a gear shaft for securing the second spur gear.

4. The mixing machine for agitating and mingling materials according to claim 1, wherein the rotary bracket further includes a bearing for fastening the fixing portion.

5. The mixing machine for agitating and mingling materials according to claim 1, wherein the driving device is a motor.

6. The mixing machine for agitating and mingling materials according to claim 1, wherein a containing bowl is disposed between the rotary bracket and the fixing portion.

* * * * *